United States Patent [19]

Hempell et al.

[11] 3,945,908

[45] Mar. 23, 1976

[54] LIQUID SEAL FOR CHLORINE HEADERS

[75] Inventors: Stephen W. Hempell, West Vancouver; Ben J. Mentz, North Vancouver, both of Canada

[73] Assignee: Hooker Chemicals & Plastics Corporation, Niagara Falls, N.Y.

[22] Filed: June 20, 1974

[21] Appl. No.: 481,298

[52] U.S. Cl. ..... 204/278; 204/258; 204/266; 204/270; 204/279

[51] Int. Cl.[2] ..... C25B 9/00

[58] Field of Search ..... 204/258, 266, 270, 278, 204/279

[56] References Cited

UNITED STATES PATENTS

| | | | |
|---|---|---|---|
| 1,131,859 | 3/1915 | Parks | 204/270 |
| 1,221,206 | 4/1917 | Mueller | 204/258 |
| 1,855,732 | 4/1932 | Smith | 204/258 |
| 2,739,936 | 3/1956 | Zdansky | 204/270 |
| 3,639,223 | 2/1972 | Blanchfield et al. | 204/270 |

*Primary Examiner*—John H. Mack
*Assistant Examiner*—W. I. Solomon
*Attorney, Agent, or Firm*—Peter F. Casella; Herbert W. Mylius

[57] ABSTRACT

An improved means for sealing the gaseous product header of an electrolytic cell is provided which comprises a water trap positioned below the gas header duct and in communication therewith, a means for draining said water trap positioned in the lower portion thereof, a liquid inlet, preferably associated with said draining means, a non-porous baffle member extending from said header into the water trap and means connecting said draining means with said cell.

4 Claims, 1 Drawing Figure

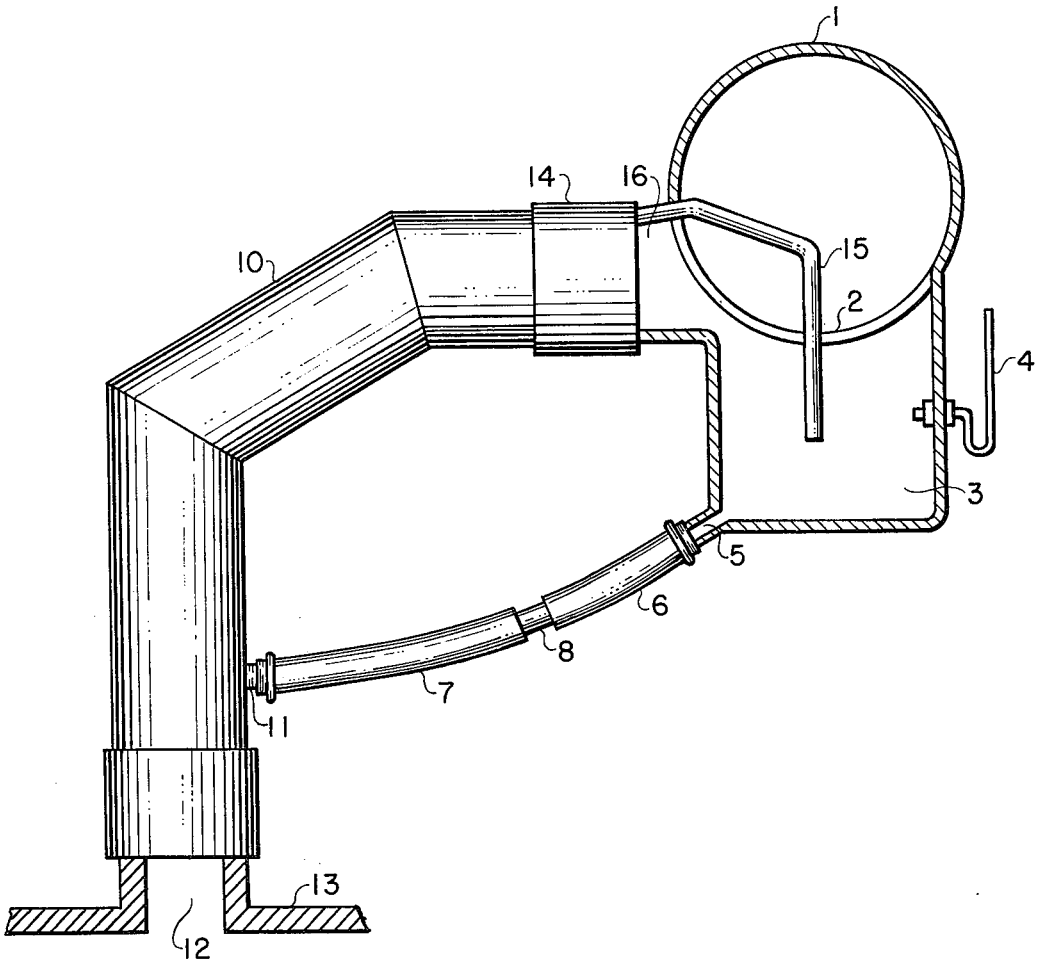
1
14
16
15
10
2
4
3
5
6
8
7
11
13
12

LIQUID SEAL FOR CHLORINE HEADERS

FIELD OF INVENTION

This invention relates to an improved means for sealing the gaseous product header associated with an electrolytic cell. More particularly, it relates to an improved header which permits the removal of an individual cell from service in an efficient and convenient manner.

BACKGROUND OF INVENTION

The electrolytic decomposition of ionizable chemical compounds, e.g., alkali metal halides is a well known commercial process. In the electrolysis of such compounds, gaseous products, e.g., chlorine, are produced as a major product. In most commercial installations a series of electrolysis cells are operated in banks and the gaseous product from each of the cells is collected and delivered into a common duct, or header, running over the top of each of the cells. Whenever one of the cells in a particular bank is shut down for maintenance or servicing, e.g., for replacement of the diaphragm or electrodes, the gaseous product line running into the header, needs to be detached from the common header. In such detaching operation a considerable amount of the gaseous product in the header will be released into the cell room unless the header is sealed off during the detachment.

Various methods have been used in the past to seal off the end of the gas product line communicating with the header. Conventionally this sealing has been provided by valving means which valving means is troublesome to maintain in liquid and/or gas tight condition and expensive to fabricate due to the highly corrosive nature of the wet chlorine gas. Further, the gaseous products emanating from the cells contain considerable amounts of water vapor which on entering into the header and cooling condense therein. This condensate is carried along with the gaseous products and, being somewhat corrosive in nature is difficult and expensive to handle.

OBJECTS OF THE INVENTION

It is therefore an object of this invention to devise an improved means for connecting and disconnecting the gaseous product stream of an electrolytic cell with a common header which services a series of electrolysis cells.

A further object is to provide a means which permits the removal of condensate from such gaseous products from the header.

These and other objects and advantages of the invention will be obvious from the following description.

BRIEF DESCRIPTION OF THE INVENTION

In accordance with the present invention, there is provided apparatus and methods for sealing the gaseous product header of a series of electrolytic cells which comprises a trap positioned below said header and communicating therewith, said trap including a means for draining liquid therefrom, means for introducing liquid into said trap, preferably associated with said draining means, a non-porous baffle within said trap spacedly positioned in relation to the communication with said header, means connecting said trap to an electrolytic cell and means connecting said draining means with the means connecting said trap to said cell.

During normal operation of the cell, the gaseous products, e.g., chlorine flows from the cell through a connecting pipe, generally called a "dogleg" into the trap around the baffle and into the header. Water vapor associated with the gas product condenses therefrom collects in the bottom of the trap and may be periodically or continuously removed through the draining means. When the cell is to be removed from service, the drain is closed and water or brine is introduced into the trap, preferably through the draining means to a height sufficient to cover the lower end of the baffle. Thereafter the dogleg may be disconnected and the cell removed without leakage of gas from the header. Preferably a liquid level indicator, e.g., a sight glass, may be installed in the trap to monitor the liquid level in the trap. Following servicing of the cell, it may be reconnected to the header and following draining of the liquid from the trap and reconnection of the connecting line to the gas outlet, the collection of gas product may be resumed.

DETAILED DESCRIPTION OF THE INVENTION

This invention may best be understood by reference to the attached drawing which illustrates a preferred embodiment of the invention. In this FIGURE, there is represented a plan view partly in section of the apparatus of this invention showing the attachment thereof to the header in accordance with the invention.

The gas product, e.g., chlorine, header, 1, having an opening, 2, in communication with trap 3 in which liquid condensate may collect. A sight glass, 4, is provided to indicate the liquid level in the trap. An opening, 5, in the bottom section of the trap permits drainage of the liquid from the trap through hoses, 6 and 7, into the dog-leg, 10, at port, 11, in the riser section of dog-leg. The dog-leg is attached to the chlorine exit port, 12, in the top of the electrolysis cell, 13 and is attached to the trap 3, at gas inlet 16. A nipple, 8, is inserted in the hose sections 6, and 7, to permit detachment thereof and insertion of a water or brine line, not shown. Dog-leg, 10, is attached to the trap 13, through a collar connector, 14. A nonporous baffle, 15, directs the flow of the chlorine through the trap into the header, 1. Similarly, when the housing contains sufficient liquid, water, brine and/or condensate to cover the lower extremity of the baffle, chlorine passing through the header is prevented from escaping into the dog-leg by the liquid seal. The baffle also serves as a means for removing any spray entrapped in the gas stream. The baffle may be fabricated from any non-corrosive metal or synthetic plastic material, e.g., polypropylene, teflon, polyvinyl acetate, chlorendic acid polyesters and the like.

During normal operation of the cell, the gaseous product formed at the anode is discharged from the cell, 13, through the gas outlet, 12, in the upper portion thereof and, passes through the dog-leg, 10, into trap, 3, around the baffle, 15, into the gas header, 1. Vapor which condenses from the hot gas collects in the trap and may be intermittently or continuously removed from the trap through the drain flowing through hose sections, 6 and 7, connecting trap, 3, with the dog-leg 10 and back into the anode compartment of the cell. The flow may be controlled by adjusting the clamp on the hose section, as will be obvious to those skilled in this art.

When the cell is to be removed from service, the electrical current is shunted around the cell interrupting the electrolysis reaction. The drain is suitably closed by clamps attached to the hose sections, 6 and 7, and the supply of feed brine to the cell is shut off. Hose lines 6 and 7 are disconnected at the nipple connection 8, and a line supplying water or brine is connected to the drain hose, 6, at the nipple connection. Thereafter trap, 3, is filled with water or brine to a level above the lower end of the baffle, 15, thereby preventing leakage of gas from the header by a liquid seal in the trap. The level of liquid in the trap may be aptly monitored by sight glass, 4. The dog-leg may be detached from the gas header and if desired, the opening in the trap closed by a suitable closure, e.g., a bung. The cell is thus detached from the gas header and trap and can be serviced.

The above described liquid seal for gas headers associated with electrolytic cells offers significant advantages over the apparatus presently in use for connecting and disconnecting cells to a collection system. Not only is the above described apparatus of relatively simple design but it does not include the use of costly valves which due to the highly corrosive atmosphere to which they are subjected, are relatively short lived and troublesome to maintain. By its use, the apparatus of this invention enables the cell to be readily removed and reinstalled in service with a minimum of gas leakage.

While there have been described various embodiments of the present invention, the apparatus features described is not intended to be understood as limiting the scope of the invention. As will be obvious to those skilled in this art, changes in the details described herein are possible without departing from the scope or spirit of the invention. It is further intended that each element recited in any of the following claims is to be understood as referring to all equivalent elements for accomplishing substantially the same results in substantially the same or equivalent manner. It is intended to cover the invention broadly in whatever form its principles may be utilized.

What is claimed is:

1. In an electrolytic cell comprising an outlet for gaseous products formed in said cell, said outlet communicating with a header for collection of the gaseous products from a series of similar cells, the improvement which comprises attaching to said header a trap comprising a. a housing having a gas inlet communicating with the gas outlet of said cell, b. a baffle positioned in and extending across said housing, said baffle being attached to the top of said gas inlet and forming a part thereof, said baffle extending downwardly into said housing and terminating above the bottom thereof, c. a liquid outlet in the lower portion of said housing, said liquid outlet being at a lower level than the lower end of said baffle, d. a liquid inlet in the lower portion of said housing, e. means for conveying liquid from said liquid outlet to the gas outlet of said cell, and f. means attached to said liquid outlet for controlling the flow of liquid from said housing, Said gas inlet and said baffle forming a path through said trap for the flow of gaseous products from said cell through said trap into said header, said trap allowing a gas flow and acting to remove spray entrapped in the gas stream during normal cell operation, said trap preventing gas flow when said trap contains liquid to a level above the lower end of said baffle.

2. The electrolytic cell as claimed in claim 1 wherein said housing includes also means for indicating externally the level of liquid in the housing.

3. The electrolytic cell as claimed in claim 2 wherein said liquid level indicating means is a sight glass.

4. The electrolytic cell as claimed in claim 1 wherein said liquid inlet and said liquid outlet are the same.

* * * * *